US006263927B1

(12) United States Patent
Carroll

(10) Patent No.: US 6,263,927 B1
(45) Date of Patent: Jul. 24, 2001

(54) VENTING TRANS-FILL STATION

(75) Inventor: Kent Carroll, Bolingbrook, IL (US)

(73) Assignee: Hose Shop, Ltd., Algonguin, IL (US)

( * ) Notice: Subject to any disclaimer, the term of this patent is extended or adjusted under 35 U.S.C. 154(b) by 0 days.

(21) Appl. No.: 09/569,272

(22) Filed: May 11, 2000

(51) Int. Cl.[7] ..... B65B 1/04

(52) U.S. Cl. ..... 141/290; 141/18; 141/21; 141/301; 137/596.2

(58) Field of Search ..... 141/285, 290, 141/301, 302, 305, 307, 18, 21, 57; 137/596.2, 627.5, 596, 596.12

(56) References Cited

U.S. PATENT DOCUMENTS

| | | | |
|---|---|---|---|
| 2,615,287 | 10/1952 | Senesky . | |
| 2,918,081 | 12/1959 | Lauer, Jr. . | |
| 3,848,631 | 11/1974 | Fallon . | |
| 3,890,999 | 6/1975 | Moskow . | |
| 3,926,208 | 12/1975 | Hoffman et al. . | |
| 4,064,890 | 12/1977 | Collins et al. . | |
| 4,181,139 | 1/1980 | Martini . | |
| 4,194,522 | 3/1980 | Lucas et al. . | |
| 4,226,257 | 10/1980 | Trinkwalder . | |
| 4,450,858 | 5/1984 | Acomb . | |
| 4,648,431 * | 3/1987 | Strongert et al. | 141/18 |
| 5,086,807 | 2/1992 | Lasnier et al. . | |
| 5,123,442 | 6/1992 | Geuy et al. . | |
| 5,234,026 | 8/1993 | Patterson . | |
| 5,280,778 | 1/1994 | Kotsiopoulos . | |
| 5,368,022 | 11/1994 | Wagner . | |
| 5,392,825 | 2/1995 | Mims et al. . | |
| 5,411,053 | 5/1995 | Markham et al. . | |
| 5,522,421 | 6/1996 | Holt et al. . | |

* cited by examiner

*Primary Examiner*—Steven O. Douglas
(74) *Attorney, Agent, or Firm*—Welsh & Katz, Ltd.

(57) ABSTRACT

A venting trans-fill station transfer is used to transfer gas from a supply tank to a second tank, and provides a vent between the supply tank and the second tank. The station includes a body defining an inlet port and a discharge port in flow communication with one another defining a fill flow path extending therebetween. The body further defines a venting port in flow communication with the fill flow path and an environment outside of the station, defining a vent flow path between the fill flow path and the environment. A vent plug port is formed in the vent flow path intermediate the fill flow path and the environment. A vent plug is configured for receipt in the vent plug port and is engagable with the plug port to isolate the fill flow path from the environment and to provide flow communication between the fill flow path and the environment.

15 Claims, 3 Drawing Sheets

VENTING TRANS-FILL STATION

FIELD OF THE INVENTION

This invention pertains to a venting trans-fill or transfer station for pressurized gases. More particularly, the present invention relates to a transfer station that is ventable for transferring a high-pressure gas from one storage container to another storage container.

BACKGROUND OF THE INVENTION

Military-like sporting events always have ever-increasing popular appeal among individuals. One military-like sporting event that has become increasingly popular is an event in which paintballs are propelled using compressed gases from a paintball gun.

Typical of these sporting events, a participant working either alone or in a group has as his or her objective the location and capture of other participants. The participant fires projectiles, such as paintballs, at the opposing participant. In that it is desirable to avoid injuring an opposing participant with the projectiles, paintballs are used. These paintballs are liquid filled projectiles that burst when striking a participant. The paint contained within the paintball provides readily visible indication that a participant has been struck.

During these sporting events, the participants carry their guns, which are powered by a compressed gas to propel the paintballs. In a typical arrangement, a small canister or bottle can be mounted directly to the gun to provide a predetermined supply of compressed gas. Alternately, a participant can carry a compressed gas bottle mounted, for example, to their back much like a scuba tank is carried by a diver. In this arrangement, the tank is connected to the gun by a hose to supply the compressed gas.

The quantity or weight of compressed gas that can be stored in these portable bottles is quite limited. To this end, subsequent to use, the bottle must be refilled. Typically, a bottle is refilled from a larger storage tank of a high pressure gas. Although the refilling of these portable bottles is a rather straightforward process, because the gas is at a high pressure, if it is mishandled or if filling is carried out incorrectly, there is the potential for injuring the individual carrying out the portable bottle refill.

Various types of valving arrangements have been used to carry out this refilling in a safe and cost-effective manner. There are, however, certain minimum requirements or design considerations that must be made to assure safe, portable bottle refilling. For example, such a transfer valving arrangement must be configured to assure that both the supply tank and the portable bottle can be isolated from one another. In addition, such a valving arrangement must also be configured to assure that the gas pathway between the storage tank and the bottle can be vented prior to disconnecting either the storage tank or bottle from the valving arrangement.

It has been observed that certain known valving arrangements include multiple component types that require considerable maintenance. If these components are not maintained properly, leakage can occur from the compressed gas pathway. In one known arrangement, a plurality of ball valves is used in order to interconnect the tank and to provide a venting pathway. It has, however, been found that such valves are generally not properly rated for this use and can leak, thus providing an undesirable pathway which, if not attended to, can ultimately result in personal injury.

Accordingly, there exists a need for a venting trans-fill station that is easy to use and that provides a controlled, venting pathway. Desirably, such a station is configured for use in high pressure gas transfer assemblies. Most desirably, such a trans-fill station minimizes the number of potential leakage pathways for escape of the pressurized gas.

SUMMARY OF THE INVENTION

A venting trans-fill station is used to transfer a gas from a supply tank to a second tank and to provide a vent between the supply tank and the second tank after filling. The station includes a body defining an inlet port and a discharge port in flow communication with one another, which define a fill flow path extending therebetween. The body further defines a venting port in flow communication with the fill flow path and an environment outside of the station. A vent flow path is defined between the fill flow path and the environment. A vent plug port is formed in the vent flow path intermediate the fill flow path and the environment.

A vent plug is configured for receipt in the vent plug port. The vent plug is engagable with the plug port to isolate the fill flow path from the environment and to provide flow communication between the fill flow path and the environment.

In a current embodiment, the vent flow path traverses through a bottom portion of the vent plug port and a side portion of the vent plug port. The portion of the vent flow path that traverses through the bottom portion of the vent plug port is in flow communication with the fill flow path, and the portion of the vent flow path that traverses through the side portion of the vent plug port is in flow communication with the venting port.

In an alternate embodiment, the body defines an inlet port, a discharge port, a venting port, a vent plug port and a shut-off port. The inlet and discharge ports are in flow communication with one another and define a fill flow path extending therebetween. The venting port is in flow communication with the fill flow path and an environment outside of the station and defines a vent flow path between the fill flow path and the environment.

The vent flow path intersects the fill flow path at a venting path/fill path juncture. The vent plug port is formed in the vent flow path intermediate the fill path and the environment. The shut-off port is disposed in the fill flow path intermediate the venting path/fill path juncture and the inlet port.

In this embodiment the vent plug is configured for receipt in the vent plug port. The vent plug is engagable with the plug port to isolate the fill flow path from the environment and to provide flow communication between the fill flow path and the environment. A shut-off plug is engagable with the shut-off port for isolating flow communication between the inlet port and the discharge port.

In still another embodiment, the venting trans-fill station body defines an inlet port and a discharge port in flow communication with one another defining a fill flow path therebetween. The body further defines a venting port in flow communication with the fill flow path and an environment outside of the station. A vent flow path is defined between the fill flow path and the environment. The body further defines a chamber common to the fill flow path and the vent flow path.

A supply seat is disposed at about a juncture of the inlet port and the chamber in the fill flow path and a venting seat is disposed at about a juncture of the vent port and the chamber in the vent flow path. The station includes an elongated plug movable through the main body for engaging the venting and supply seats. When the elongated plug is engaged with the supply seat the vent flow path provides flow communication between the chamber and the environment, and when the elongated plug is engaged with the venting seat the fill flow path provides flow communication between the inlet port and the discharge port.

In a preferred configuration of this embodiment, the supply seat and the venting seat are each formed having a beveled surface for engaging and centering the elongated plug as it traverses through the respective seats. Most preferably, seals are disposed at the venting and supply seats in opposing relation to the beveled surfaces, and the seats maintain the seals in place to provide a gas-tight seal.

The station can be configured having an inlet side insert and a plug side insert. The inserts engage the supply and venting seats, respectively, to position the seats within the station body and to secure seals at the seats. The elongated plug can include a connecting portion having a sealing area and a seal to further maintain the station in a gas-tight condition.

These and other features and advantages of the present invention will be apparent from the following detailed description, the accompanying drawings, and the appended claims.

DETAILED DESCRIPTION OF THE PREFERRED EMBODIMENTS

Figure 1:
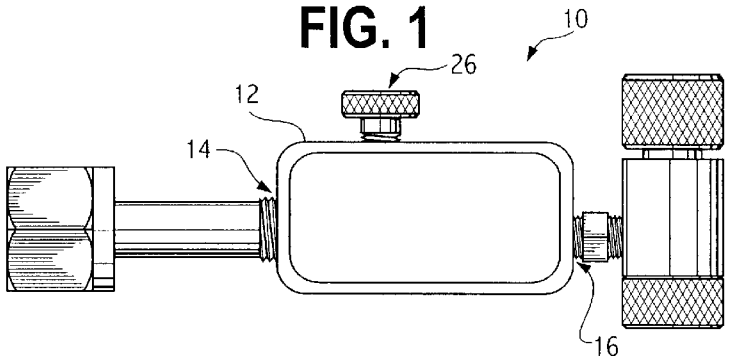
FIG. 1 is a front view of an embodiment of the venting trans-fill station embodying the principles of the present invention, the station being illustrated with a storage tank inlet fitting, a portable bottle delivery fitting and a vent plug in place in the station body.
Figure 2:
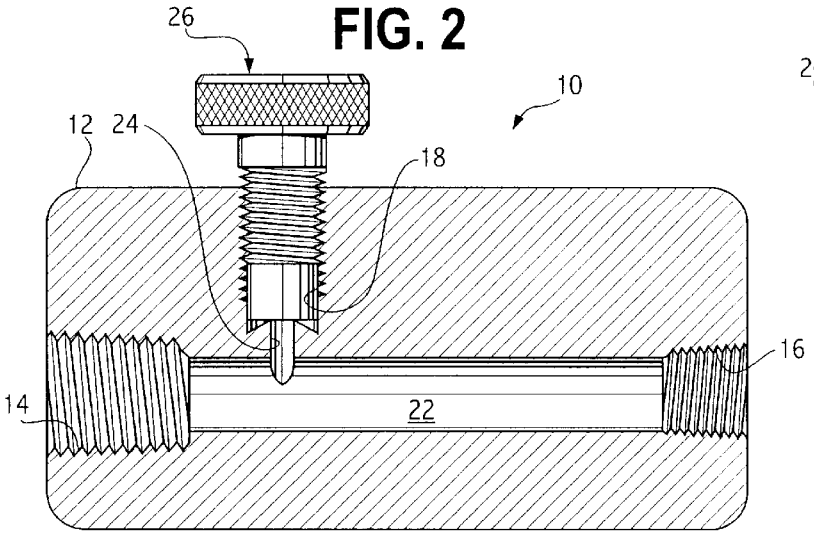
FIG. 2 is a partial cross-sectional view of the trans-fill station of FIG. 1, illustrated with the vent plug in place in the station body and with the inlet and delivery fitting removed.
Figure 5:
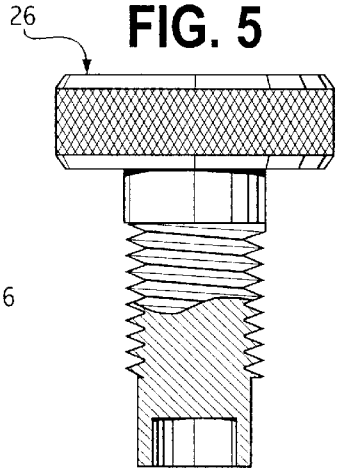
FIG. 5 is a front view of the vent plug of FIG. 2.
Figure 3:
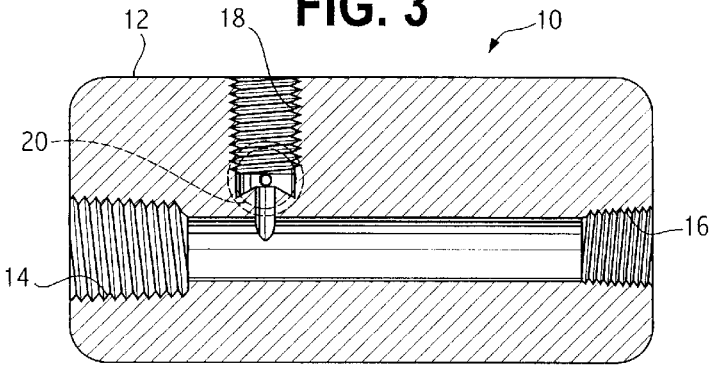
FIG. 3 is a view similar to FIG. 2 with the vent plug removed for clarity of illustration.
Figure 4:
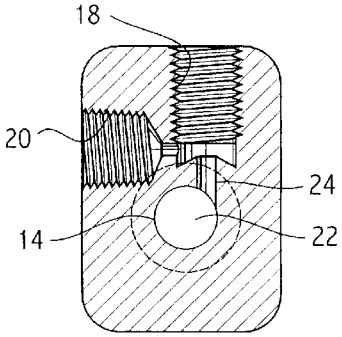
FIG. 4 is a side view of the station of FIG. 3, as viewed from the left-hand side thereof.
Figure 6:
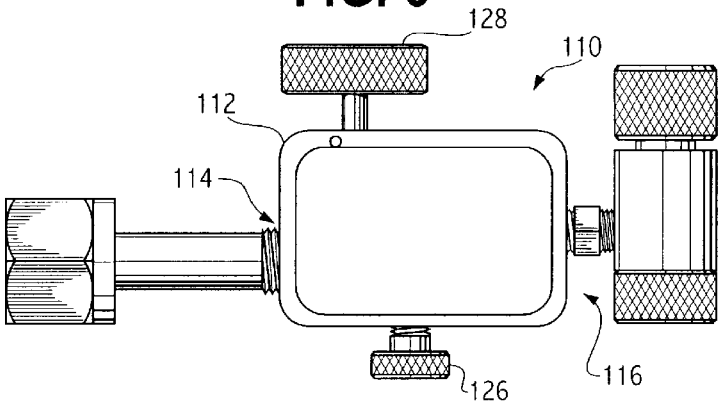
FIG. 6 is a front view of an alternate embodiment of the venting trans-fill station embodying the principles of the present invention, the station being illustrated with a storage tank inlet fitting, a portable bottle delivery fitting and vent and shut-off plugs in place in the station body.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIGS. 1–5, there is shown one embodiment 10 of a venting trans-fill station in accordance with the principles of the present invention. The station 10 includes a main body 12 having an inlet port 14, a discharge port 16, a vent plug port 18 and a venting port 20. The inlet port 14 is that port of the station 10 that is in flow communication with a relatively large quantity of compressed gas, such as that available from a storage tank (not shown). The discharge port 16 is that port that is in flow communication with, for example, a portable compressed gas bottle (not shown).

An unobstructed fill flow path 22 extends between the inlet port 14 and the discharge port 16. It is through this path 22 that compressed gas flows from the supply tank to the portable bottle.

A vent flow path 24 extends from the fill flow path 22 in the body 12 of the station 10, intermediate the inlet port 14 and the discharge port 16. The vent flow path 24 extends to the venting port 20, where it is in flow communication with the environs. The vent plug port 18 intersects the vent flow path 24 and includes a region that is configured to receive a plug 26 to isolate the vent flow path 24 (and thus, the fill flow path 22) from the environs. In a current embodiment, the vent plug port 18 is threaded and is configured to receive the complementary threaded plug 26 for sealing that port 18. By sealing the port 18, both the vent flow path 24 and the fill flow path 22 are isolated from the environs.

In this embodiment, all of the ports 14–20 are threaded and are configured to receive standard connectors and/or fittings as used in the industry. In the present embodiment, the inlet port 14 is threaded for receipt of a ¼ inch NPT thread. The discharge port 16 is threaded and is configured for receipt of a ⅛ inch NPT thread. The vent plug port 18 is configured for receipt of a ⅜ by 24 threaded plug 26, such as that illustrated in FIG. 5.

An alternate embodiment 110 of the trans-fill station is best seen in FIGS. 6 through 10. In this alternate embodiment 110, the station includes a body 112 having an inlet port 114, a discharge port 116, a vent plug port 118 and a venting port 120. A fill flow path 122 is defined from the inlet port 114 to the discharge port 116 and a vent flow path 124 is defined, intersecting the fill flow path 122. A vent plug 126 is threaded into the body 112 of the station 110 at the vent plug port 118 for isolating and initiating flow through the venting port 120. The vent plug 126 is similar to the vent plug 26 illustrated in FIG. 5.

In this embodiment, the station 110 includes a shut-off valve or plug 128. The shut-off plug 128 is received in a threaded shut-off port 130 in the body 112 of the station 110. The plug 128 is configured for engaging a plug seat 132 formed in the body 112 of the station 110. The seat 132 is formed intersecting the fill flow path 122, intermediate the inlet and discharge ports, 114, 116, respectively. The seat 132 is intermediate the inlet 114 and a venting path/fill path juncture, as indicated at 134.

Figure 7:
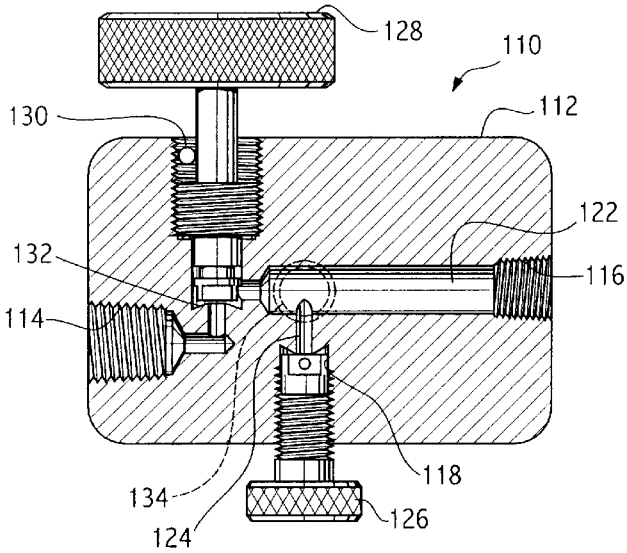
FIG. 7 is a partial cross-sectional view of the trans-fill station of FIG. 6, illustrated with the vent and shut-off plugs in place in the station body, and with the inlet and delivery fittings removed.

In a current embodiment, the fill flow path 122 is formed having a 90 degree bend at the seat 132 so that when the plug 128 is tightened down into the body 112, a base portion of the plug, as indicated at 136, engages the seat 132 to isolate the flow of gas through the fill flow path 122. As best seen in FIG. 7, the fill flow path 122 is configured so that the flow of gas from the high pressure inlet port 114 travels through a base portion 138 of the seat 132 and the outlet portion (to the discharge port 116) intersects a side 140 of the plug 128. In this manner, any pressure that is exerted on the plug 128 (from the high pressure gas) is equally distributed about the seat 132 and thus the plug 128, and is exerted on the plug base 136.

As will be recognized from the figures, the plug 128 permits isolating the supply tank, at the station 110, so that the portable bottle can be isolated, and the fill flow path 122 vented without the need for additional valves at the supply tank.

Figure 10:
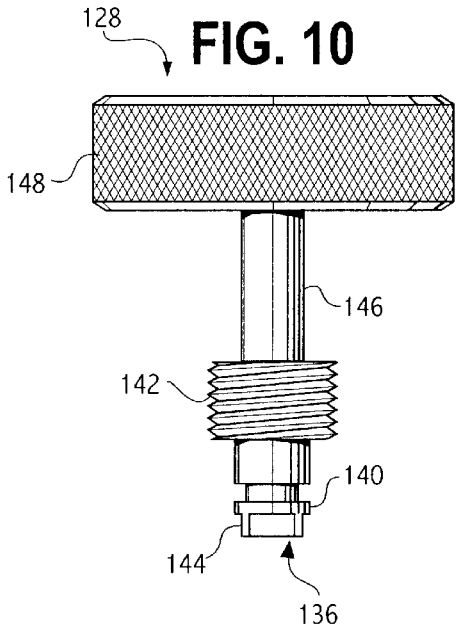
FIG. 10 is a front view of the vent plug of FIG. 7.
Figure 8:
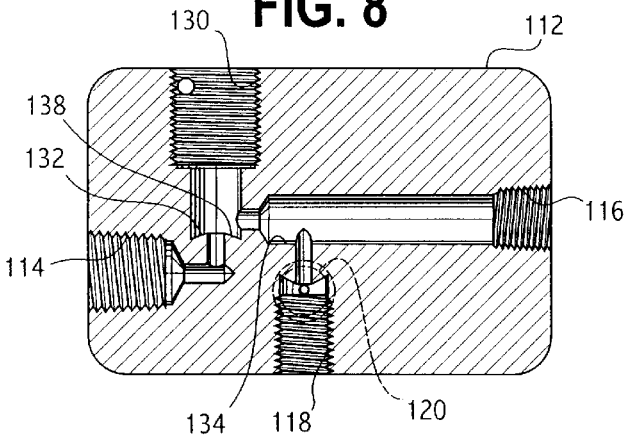
FIG. 8 is a view similar to FIG. 7 with the vent and shut-off plugs removed for clarity of illustration.
Figure 9:
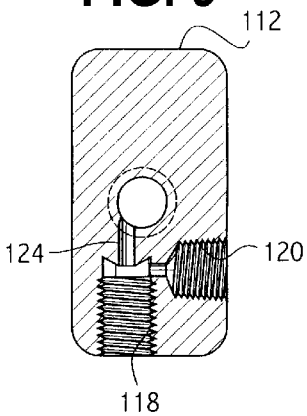
FIG. 9 is a side view of the station of FIG. 8, as viewed from the left-hand side thereof.
Figure 11:
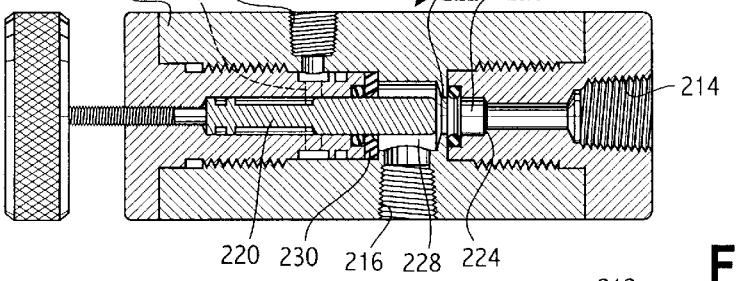
FIG. 11 is a partial cross-sectional view of another alternate embodiment of the venting trans-fill station embodying the principles of the present invention, the station being illustrated with a single vent and fill plug, the plug being shown in the fill position.

An exemplary plug 128 for use in this embodiment of the fill station 110 is illustrated in FIG. 10. As can be seen from this figure, the plug 128 includes a threaded portion 142 that is configured for receipt in the shut-off plug port 130. The plug base 136 is configured having a substantially circular wall portion 144 that engages the seat 132 to isolate the flow of gas from the bottom thereof. The plug 128 further includes a stem 146 and an upper threaded portion (not shown) at about the end of the stem 146 for receipt of a knurled knob 148 or the like for ease of use.

As will be readily recognized from these figures, in this embodiment of the trans-fill station 110, two discrete and separate plugs or valves are used for filling and venting. The shut-off plug 128 is used to initiate and isolate flow between the supply tank and the portable bottle through the fill flow path 122. The vent plug 126 permits venting the station 110 after the portable bottle has been filled and the supply or storage tank has been isolated.

Still another embodiment of the trans-fill station 210 is shown in FIGS. 11 through 16. In this embodiment of the station 210, as will be described below, a single valve assembly is used for both supply tank isolation and venting.

Figure 12:
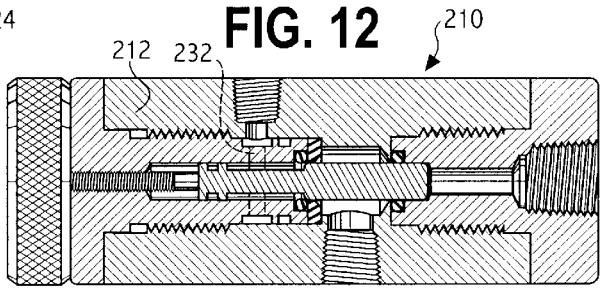
FIG. 12 is a view of the station of FIG. 11 with the plug shown in the vent position.
Figure 14:
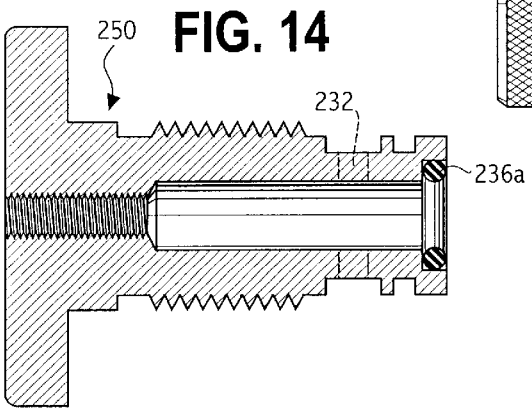
FIG. 14 is a front view of the plug side insert of the station of FIGS. 11–13.
Figure 15:
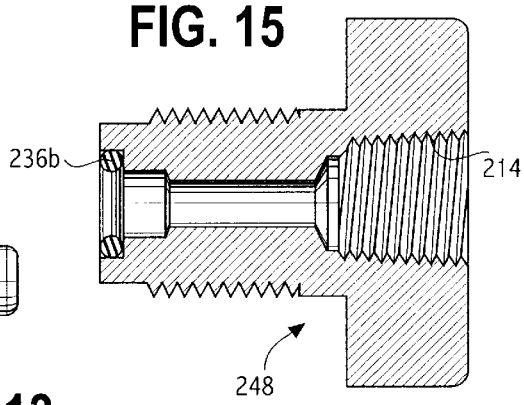
FIG. 15 is a front view of the inlet side insert of the station of FIGS. 11–13.

This embodiment of the station 210 includes a main body 212 portion having an inlet port 214, a discharge port 216, and a venting port 218. The station 210 includes an elongated plug 220 that is movable within the body 212. A first seat or supply seat 222 is positioned at an end 224 of the inlet port 214 within a fill flow path 226. The supply seat 222 is at an end of, and opens into a chamber 228 within the station 210 that is in flow communication with the discharge port 216. The plug 220 is configured to move within the station 210 to seal against the supply seat 222 for isolating flow between the inlet and discharge ports, 214, 216, respectively (FIG. 12).

A second or venting seat 230 functions as a retaining collar and is disposed within the station 210, at another end of the chamber 228, that is configured to cooperate with the plug 220 to isolate the chamber 228 from the venting port 218. Essentially, the station 210 defines a chamber 228 separated from the inlet and venting ports, 214, 218, respectively, by the supply and venting seats 222, 230, respectively. As the plug 220 is moved into engagement with the supply seat 222 (FIG. 12), it moves out of engagement with (or off of) the venting seat 230 and thus establishes a venting flow path 232 from the chamber 228 to the venting port 218. Conversely, as the plug 220 is moved into engagement with the venting seat 230 (FIG. 11), and out of engagement with (or off of) the supply seat 222, the fill flow path 226 is established from the inlet port 214 into the chamber 228 and out through the discharge port 216.

Each of the supply and venting seats 222, 230 includes an angled or beveled surface 234 to maintain the plug 220 centered as it engages and traverses into the seats 222, 230. In addition, seals 236, such as the illustrated, exemplary O-rings, are provided on a back end 238 of each of the seats 222, 230, opposing the beveled surfaces 234, to assure a gas tight seal between the plug 220 and the respective seats 222, 230.

Figure 16:
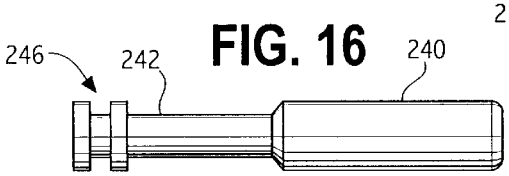
FIG. 16 is a front view of the vent and fill plug.

The plug 220, as best seen in FIG. 16, is configured having an elongated sealing section 240, which is that section that seals against the supply and venting seats 222, 230, and a connecting portion 242 extending from the sealing section 240 to a threaded stem 244. The connecting portion 242 can include a sealing area 246 and a seal (not shown) at about a juncture with the stem 244 to prevent the flow of gas past the connecting portion 242 and up about the threads on the stem 244. A knurled knob 247 or the like is mounted to the stem 244 to facilitate ready use of the station 210.

Figure 13:
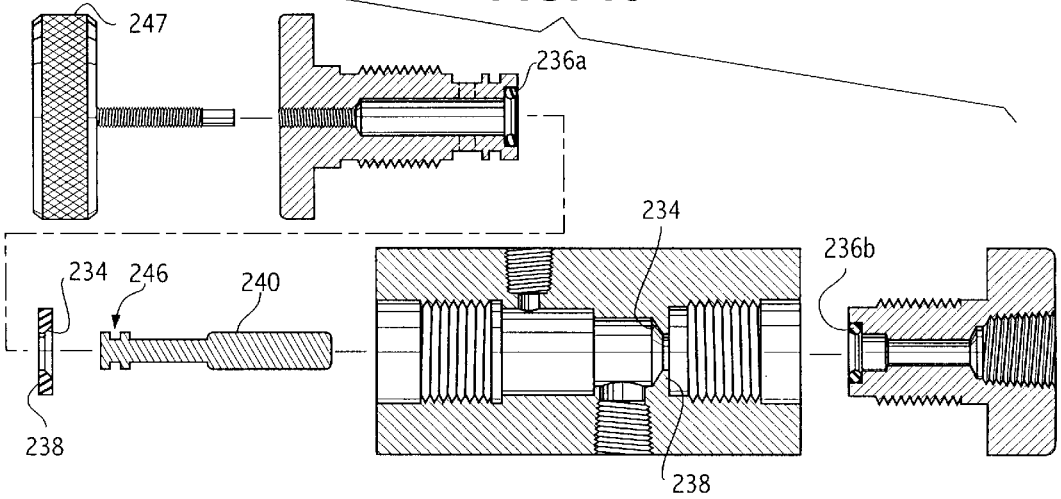
FIG. 13 is an exploded view of the station of FIGS. 11 and 12.

Referring to FIG. 13, an exploded view of this embodiment of the station 210 shows that the body 212 includes first and second or inlet side and plug side inserts, 248, 250, respectively. The inserts 248, 250 are configured for receipt in threaded bores 252 in the body 212. The inlet side insert 248 is configured to maintain the seal 236a positioned within the body 21 and to maintain it in place by cooperation of the insert 248 with the body 212. The plug side insert 250 is likewise configured to maintain proper positioning of the vent seat 230 and seal 236*b*, between the insert 250 and the station body 212. The plug side insert 250 is also configured to maintain centering and proper positioning and movement of the plug 220 within the insert 250 and station body 212.

In preferred embodiments of each of the first, second and third embodiments 10, 110, 210, the station bodies can be formed from, for example, a cast block of aluminum or the like. It has been found that such an aluminum body is readily manufactured and machined within the tolerances necessary for the present stations in an efficient and cost effective manner. It has been found that the present trans-fill stations can be readily manufactured to the standards established by governmental and industry groups (e.g., ASME) for their intended use.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A venting trans-fill station for transferring a gas from a supply tank to a second tank and for providing a vent between the supply tank and the second tank, the station comprising:

a body defining an inlet port and a discharge port in flow communication with one another defining a fill flow path extending therebetween, the body further defining a venting port in flow communication with the fill flow path and an environment outside of the station and defining a vent flow path between the fill flow path and the environment, the body further defining a vent plug port formed in the vent flow path intermediate the fill flow path and the environment, the vent flow path traversing through a bottom portion of the vent plug port and a side portion of the vent plug port; and a vent plug configured for receipt in the vent plug port, the vent plug engagable with the plug port to isolate the fill flow path from the environment and to provide flow communication between the fill flow path and the environment.

2. The trans-fill station in accordance with claim 1 wherein the vent flow path traversing through the bottom portion of the vent plug port is in flow communication with the fill flow path and wherein the vent flow path traversing through the side portion of the vent plug port is in flow communication with the venting port.

3. The trans-fill station in accordance with claim 1 wherein the vent flow path intersect the fill flow path at a venting path/fill path juncture, and including a shut off port disposed in the fill flow path intermediate the venting path/fill path juncture and the inlet port, and including a shut-off plug engagable with the shut-off port for isolating flow communication between the inlet port and the discharge port.

4. The trans-fill station in accordance with claim 3 wherein the vent plug and the shut-off plug are in opposing relation to one another.

5. The trans-fill station in accordance with claim 1 including a chamber defined within the fill flow path, wherein the venting flow path extends from the chamber to the venting port, wherein the station includes a supply seat at about a juncture of the inlet port and the chamber and a venting seat at about a juncture of the venting flow path and the chamber, and wherein the station includes an elongated plug movable through the main body for engaging the venting and supply seats, and wherein when the elongated plug is engaged with the supply seat a flow path is defined from the chamber to the venting port, and when the elongated plug is engaged with the venting seat a flow path is defined from the inlet port to the discharge port.

6. A venting trans-fill station for transferring a gas from a supply tank to a second tank and for providing a vent between the supply tank and the second tank, the station comprising:

a body defining an inlet port, a discharge port, a venting port, a vent plug port and a shut-off port, the inlet and discharge ports being in flow communication with one another and defining a fill flow path extending therebetween, the venting port being in flow communication with the fill flow path and an environment outside of the station and defining a vent flow path between the fill flow path and the environment, the vent flow path intersecting the fill flow path at a venting path/fill path juncture, the a vent plug port being formed in the vent flow path intermediate the fill flow path and the environment, the shut-off port being disposed in the fill flow path intermediate the venting path/fill path juncture and the inlet port;

a vent plug configured for receipt in the vent plug port, the vent plug engagable with the plug port to isolate the fill flow path from the environment and to provide flow communication between the fill flow path and the environment; and a shut-off plug engagable with the shut-off port for isolating flow communication between the inlet port and the discharge port.

7. The trans-fill station in accordance with claim 6 wherein the vent plug and the shut-off plug are in opposing relation to one another.

8. A venting trans-fill station for transferring a gas from a supply tank to a second tank and for providing a vent between the supply tank and the second tank, the station comprising:

a body defining an inlet port and a discharge port in flow communication with one another defining a fill flow path extending therebetween, the body further defining a venting port in flow communication with the fill flow path and an environment outside of the station and defining a vent flow path between the fill flow path and the environment, the body further defining a chamber common to the fill flow path and the vent flow path;

a supply seat disposed at about a juncture of the inlet port and the chamber in the fill flow path;

a venting seat at disposed about a juncture of the vent port and the chamber in the vent flow path; and an elongated plug movable through the main body for engaging the venting and supply seats, wherein when the elongated plug is engaged with the supply seat the vent flow path provides flow communication between the chamber and the environment and when the elongated plug is engaged with the venting seat the fill flow path provides flow communication between the inlet port and the discharge port.

9. The trans-fill station in accordance with claim 8 wherein the supply seat and the venting seat are each formed having a beveled surface for engaging and centering the elongated plug as it traverses through the respective seats.

10. The trans-fill station in accordance with claim 9 wherein the station includes seals disposed at the venting and supply seats in opposing relation to the beveled surfaces.

11. The trans-fill station in accordance with claim 8 wherein the station includes an inlet side insert and a plug side insert.

12. The trans-fill station in accordance with claim 11 wherein the plug side insert engages the venting seat to position the venting seat within the station body and to secure a seal at the venting seat.

13. The trans-fill station in accordance with claim 11 wherein the inlet side insert engages the supply seat to secure a seal at the supply seat.

14. The trans-fill station in accordance with claim 11 wherein the elongated plug includes a connecting portion having a sealing area.

15. The trans-fill station in accordance with claim 14 including a seal at the sealing area.

* * * * *